US005531840A

United States Patent [19]

Uesugi et al.

[11] Patent Number: 5,531,840

[45] Date of Patent: Jul. 2, 1996

[54] METHOD OF PRODUCING SUPPORT FOR PLANOGRAPHIC PRINTING PLATE

[75] Inventors: Akio Uesugi; Tsutomu Kakei, both of Shizuoka, Japan

[73] Assignee: Fuji Photo Film Co., LTD., Kanagawa, Japan

[21] Appl. No.: 340,886

[22] Filed: Nov. 15, 1994

[30] Foreign Application Priority Data

Nov. 15, 1993 [JP] Japan ..... 5-307109

[51] Int. Cl.[6] ..... C22F 1/04

[52] U.S. Cl. ..... 148/552; 148/551; 148/692; 148/695; 148/437; 164/476; 164/477

[58] Field of Search ..... 148/551, 552, 148/692, 695, 437; 164/476, 477

[56] References Cited

U.S. PATENT DOCUMENTS 5,078,805 1/1992 Uesugi et al. ..... 148/437

5,350,010 9/1994 Sawada et al. ..... 164/476

FOREIGN PATENT DOCUMENTS 0281238 9/1988 European Pat. Off. .

0415238 3/1991 European Pat. Off. .

OTHER PUBLICATIONS

DATABASE WPI, Section Ch, Week 9329, Derwent Publications Ltd., London, GB; Class M14, AN 93-232762 for JP-A-5-15614 (Jun. 1993).

*Primary Examiner*—David A. Simmons
*Assistant Examiner*—Robert R. Koehler
*Attorney, Agent, or Firm*—Sughrue, Mion, Zinn, Macpeak & Seas

[57] ABSTRACT

A method of producing a support for a planographic printing plate, which comprises after continuous casting an aluminum plate having a thickness of not more than 3 mm from molten aluminum by a twin roller continuous casting method, heat-treating the aluminum plate and then reducing the thickness of the plate to 0.5 mm or less by cold rolling.

2 Claims, 1 Drawing Sheet

METHOD OF PRODUCING SUPPORT FOR PLANOGRAPHIC PRINTING PLATE

FIELD OF THE INVENTION

The present invention relates to a method of producing a support for planographic printing plate and more particularly relates to a method of producing an aluminum support which is superior in an electrolytically graining property.

BACKGROUND OF THE INVENTION

As an aluminum support for printing plate, particularly for offset printing plate there is used an aluminum plate (including aluminum alloy plate).

In general, an aluminum plate to be used as a support for offset printing plate needs to have a proper adhesion to a photographic light-sensitive material and a proper water retention.

The surface of the aluminum plate should be uniformly and finely grained to meet the aforesaid requirements. This graining process largely affects a printing performance and a durability of the printing plate upon the printing process following manufacture of the plate. Thus, it is important for the manufacture of the plate whether such graining is satisfactory or not.

In general, an alternating current electrolytic graining method is used as the method of graining an aluminum support for a printing plate. There are a variety of suitable alternating currents, for example, a normal alternating waveform such as a sinewaveform, a special alternating waveform such as a squarewaveform, and the like. When the aluminum support is grained by alternating current supplied between the aluminum plate and an opposite electrode such as a graphite electrode, this graining is usually conducted only one time, as the result of which, the depth of pits formed by the graining is small over the whole surface thereof. Also, the durability of the grained printing plate during printing will deteriorate. Therefore, in order to obtain a uniformly and closely grained aluminum plate satisfying the requirement of a printing plate with deep pits as compared with their diameters, a variety of methods have been proposed as follows.

One method is a graining method to use a current of particular waveform for an electrolytic power source (JP-A-53-67507). (The term "JP-A" as used herein means an "unexamined published Japanese patent application".) Another method is to control a ratio between an electricity quantity of a positive period and that of a negative period at the time of alternating electrolytic graining (JP-A-54-65607). Still another method is to control the waveform supplied from an electrolytic power source (JP-A-55-25381). Finally, another method is directed to a combination of current density (JP-A-56-29699).

Further, known is a graining method using a combination of an AC electrolytic etching method with a mechanical graining method (JP-A-55-142695).

As the method of producing an aluminum support, on the other hand, known is a method in which an aluminum ingot is melted and held, and then cast into a slab (having a thickness in a range from 400 to 600 mm, a width in a range from 1,000 to 2,000 mm, and a length in a range from 2,000 to 6,000 mm). Then, the cast slab thus obtained is subjected to a scalping step in which the slab surface is scalped by 3 to 10 mm with a scalping machine so as to remove an impurity structure portion on the surface. Next, the slab is subjected to a soaking treatment step in which the slab is kept in a soaking furnace at a temperature in a range from 480° to 540° C. for a time in a range from 6 to 12 hours, thereby to remove any stress inside the slab and make the structure of the slab uniform. Then, the thus treated slab is hot rolled at a temperature in a range from 480° to 540° C. to a thickness in a range from 5 to 40 mm. Thereafter, the hot rolled slab is cold rolled at room temperature into a plate of a predetermined thickness. Then, in order to make the structure uniform and improve the flatness of the plate, the thus cold rolled plate is annealed thereby to make the rolled structure, etc. uniform, and the plate is then subjected to correction by cold rolling to a predetermined thickness. Such an aluminum plate obtained in the manner described above has been used as a support for a planographic printing plate.

However, electrolytic graining is apt to be influenced by an aluminum support to be treated. If an aluminum support is prepared through melting and holding, casting, scalping and soaking, even through passing through repetition of heating and cooling followed by scalping of a surface layer, scattering of the metal alloy components is generated in the surface layer, causing a drop in the yield of a planographic printing plate.

The present inventors previously proposed a method of producing a support for a planographic printing plate by making a thin plate having a thickness of from 4 mm to 30 mm by a direct continuous casting rolling method using a twin roller, reducing the thickness of the plate to from 60% to 95% by cold rolling, thereafter, annealing the plate at a temperature of from 260° C. to 300° C. for at least 8 hours, and then further reducing the thickness of the thin plate to from 30% to 90% by finish cold rolling.

The foregoing process is a very excellent system but since in the process, the steps of continuous casting, cold rolling, annealing, and cold rolling are carried out, there is a disadvantage that two cold rollings are required.

Also, recently, a support for a planographic printing plate having a good appearance after electrolytic graining and having more excellent graining has been demanded.

SUMMARY OF THE INVENTION

An object of the present invention is, therefore, to simplify the production steps and to provide a method of producing a support for a planographic printing plate capable of making a planographic printing plate having a good appearance after electrolytic graining and having more excellent graining.

As the result of various investigations on producing aluminum supports for planographic printing plates, it has been discovered that the above-described object can be attained by the present invention as described hereinbelow.

That is, according to the first aspect of the present invention, there is provided a method of producing a support for a planographic printing plate, which comprises after continuous casting an aluminum plate having a thickness of not more than 3 mm (preferably 1.0 to 2.5 mm) from molten aluminum (alloy) by a twin roller continuous casting method, heat-treating the aluminum plate and then reducing the thickness of the aluminum plate to 0.5 mm or less (preferably 0.1 to 0.5 mm) by cold rolling.

Also, according to the second aspect (i.e., the preferred embodiment) of the present invention, there is provided a method of producing a support for a planographic printing plate described in the first aspect, wherein the temperature of the heat treatment is at least 300° C. (particularly preferably 400° to 550° C.).

According to the third aspect (i.e., the preferred embodiment) of the present invention, there is provided a method of producing a support for a planographic printing plate described in the first aspect, wherein the temperature-raising speed for the heat treatment is at least 1° C./second (particularly preferably 3 to 150° C./second).

Furthermore, according to the fourth aspect (i.e., the preferred embodiment) of the present invention, there is provided a method of producing a support for a planographic printing plate described in the first, second or third aspect, wherein the continuous casting method is carried out by twin belt continuous casting and hot rolling the molten aluminum (alloy).

DETAILED DESCRIPTION OF THE INVENTION

Then, the present invention is described in detail.

As a method of forming a thin plate coil by continuous casting-rolling the molten aluminum directly into a plate form using a twin roller in the present invention, a thin-plate continuous casting technique such as a Hunter method, a 3C method, etc., is practically used. Also, a method of forming a coil of a thin plate is disclosed in JP-A-60-238001, JP-A-60-240360, etc., (the term "JP-A" as used herein means an "unexamined published Japanese patent application").

In the process of the present invention, first, an aluminum thin plate having a thickness of not more than 3 mm (preferably 1.0 to 2.5 mm) is formed by twin roller continuous casting rolling.

In this case, it is necessary to apply a rolling force of at least 100 tons/m to the twin roller and hot rolling is combined with the twin roller rolling. Also, as a twin belt continuous casting and hot rolling method, the techniques such as a Hazelett method, etc., has been practically used.

Then, a heat treatment (annealing) is carried out. Examples of an annealing system include a batch system, a continuous annealing system, an induction heating system, etc., and it is preferred that the temperature-raising speed is at least 1° C./second (particularly 3° to 150° C./second) and the temperature is at least 300° C. (preferably 400° to 550° C.).

Thereafter, by finish rolling (cold rolling) the plate, a thin plate having a thickness of not more than 0.5 mm (preferably 0.1 to 0.5 mm) is formed and then the thin plate is passed to a correction (i.e., straightening) apparatus.

Then, the method of producing an aluminum support for a planographic printing plate of the present invention is explained more practically by referring to FIG. 1 showing a schematic view of the production steps of the present invention.

Figure 1A:
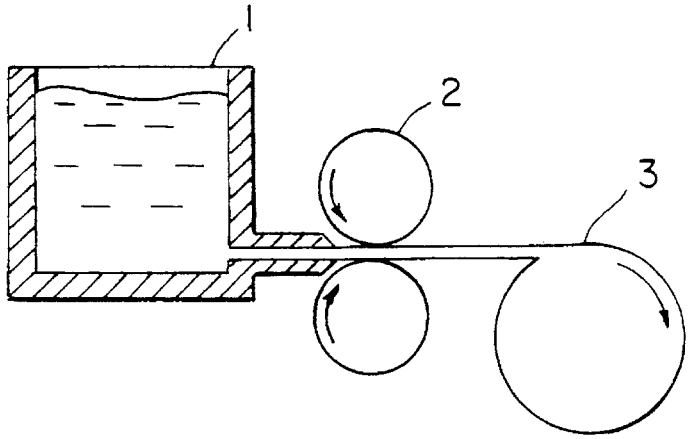
FIG. 1 is a schematic view showing the method of producing a planographic printing plate of the present invention, wherein (A) is a continuous casting apparatus, (B) is a continuous annealing apparatus, (C) is a cold rolling apparatus, and (D) a correction (i.e., straightening) apparatus.
Figure 1B:
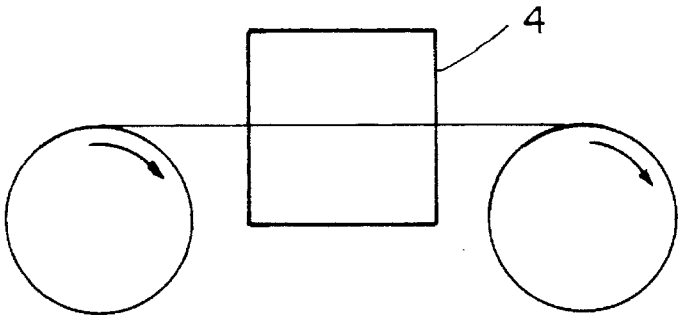

As shown in FIG. 1(A), a molten aluminum ingot is held in a melt holding furnace 1. The molten metal is sent to a twin roller continuous casting apparatus 2 from the furnace to form a hot rolled thin plate having a thickness of not more than 3 mm and the thin plate is coiled by a coiler 3. FIG. 1(B) shows a continuous annealing apparatus 4 and in the annealing apparatus, it is preferred that the temperature is at least 300° C. and the temperature raising speed is at least 1° C./second. As the annealing apparatus, there are a gas furnace continuous system, an induction heating furnace continuous system, etc., but a batch system may be also used.

Figure 1C:
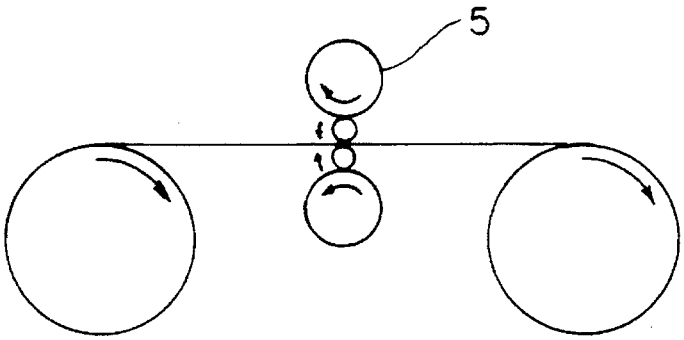
Figure 1D:
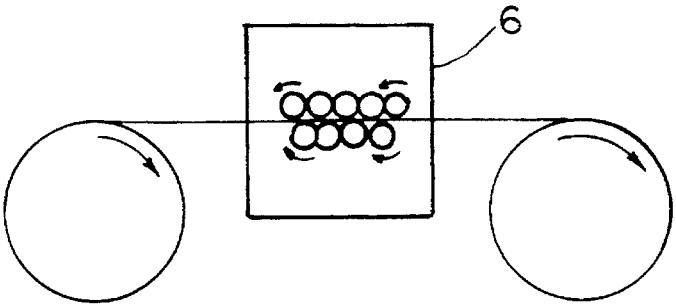

Thereafter, the thin plate is treated by a cold rolling apparatus 5 as shown in FIG. 1(C) to form a thin plate having a thickness of not more than 0.5 mm, and then passed to a correction (i.e., straightening) apparatus as shown in FIG. 1(D).

As the method for graining the support for planographic printing plate according to the present invention, there is used mechanical graining, chemical graining, electrochemical graining or combination thereof.

Examples of mechanical graining methods include ball graining, wire graining, brush graining, and liquid honing. As electrochemical graining method, there is normally used AC electrolytic etching method. As electric current, there is used a normal alternating current such as sinewaveform or a special alternating current such as squarewaveform, and the like. As a pretreatment for the electrochemical graining, etching may be conducted with caustic soda.

If electrochemical graining is conducted, it is preferably carried out with an alternating current in an aqueous solution mainly composed of hydrochloric acid or nitric acid. The electrochemical graining will be further described hereinafter.

First, the aluminum is etched with an alkali. Preferred examples of alkaline agents include caustic soda, caustic potash, sodium metasilicate, sodium carbonate, sodium aluminate, and sodium gluconate. The concentration of the alkaline agent, the temperature of the alkaline agent and the etching time are preferably selected from 0.01 to 20%, 20° to 90° C. and 5 min., respectively. The preferred etching rate is in the range of 0.1 to 5 g/m$^2$.

In particular, if the support contains a large amount of impurities, the etching rate is preferably in the range of 0.01 to 1 g/m$^2$ (JP-A-1-237197). Since alkaline-insoluble substances (smut) are left on the surface of the aluminum plate thus alkali-etched, the aluminum plate may be subsequently desmutted as necessary.

The pretreatment is effected as mentioned above. In the present invention, the aluminum plate is subsequently subjected to AC electrolytic etching in an electrolyte mainly composed of hydrochloric acid or nitric acid. The frequency of the AC electrolytic current is in the range of generally 0.1 to 100 Hz, preferably 0.1 to 1.0 Hz or 10 or 60 Hz.

The concentration of the etching solution is in the range of generally 3 to 150 g/l, preferably 5 to 50 g/l. The solubility of aluminum in the etching bath is preferably in the range of not more than 50 g/l, more preferably 2 to 20 g/l. The etching bath may contain additives as necessary. However, in mass production, it is difficult to control the concentration of such an etching bath.

The electric current density in the etching bath is preferably in the range of 5 to 100 A/dm$^2$, more preferably 10 to 80 A/dm$^2$. The waveform of electric current can be properly selected depending on the required quality and the components of aluminum support used but may be preferably a special alternating waveform as described in JP-B-56-19280 and JP-B-55-19191 (corresponding to U.S. Pat. No. 4,087,341). (The term "JP-B" as used herein means an "examined Japanese patent publication"). The waveform of electric current and the liquid conditions are properly selected depending on required electricity as well as required quality and components of aluminum support used.

The aluminum plate which has been subjected to electrolytic graining is then subjected to dipping in an alkaline solution as a part of desmutting treatment to dissolve smutts away. As such an alkaline agent, there may be used caustic soda or the like. The desmutting treatment is preferably effected at a pH value of not lower than 10 and a temperature of 25° to 60° C. for a dipping time as extremely short as 1 to 10 seconds.

The aluminum plate thus-etched is then dipped in a solution mainly composed of sulfuric acid. It is preferred that the sulfuric acid solution is in the concentration range of 50 to 400 g/l, which is much lower than the conventional value, and the temperature range of 25° to 65° C. If the concentration of sulfuric acid is more than 400 g/l or the temperature of sulfuric acid is more than 65° C., the processing bath is more liable to corrosion, and in an aluminum alloy comprising not less than 0.3% of manganese, the grains formed by the electrochemical graining is collapsed. Further, if the aluminum plate is etched by more than 1.0 $g/m^2$, the printing durability reduces. Thus, the etching rate is preferably controlled to not more than 1.0 $g/m^2$.

The aluminum plate preferably forms an anodized film thereon in an amount of 0.1 to 10 $g/m^2$, more preferably 0.3 to 5 $g/m^2$.

The anodizing conditions vary with the electrolyte used and thus are not specifically determined. In general, it is appropriate that the electrolyte concentration is in the range of 1 to 80% by weight, the electrolyte temperature is in the range of 5° to 70° C., the electric current density is in the range of 0.5 to 60 $A/dm^2$, the voltage is in the range of 1 to 100 V, and the electrolysis time is in the range of 1 second to 5 minutes.

The grained aluminum plate having an anodized film thus-obtained is stable and excellent in hydrophilicity itself and thus can directly form a photosensitive coat thereon. If necessary, the aluminum plate may be further subjected to surface treatment.

For example, a silicate layer formed by the foregoing metasilicate of alkaline metal or an undercoating layer formed by a hydrophilic polymeric compound may be formed on the aluminum plate. The coating amount of the undercoating layer is preferably in the range of 5 to 150 $mg/m^2$.

A photosensitive coat is then formed on the aluminum plate thus treated. The photosensitive printing plate is imagewise exposed to light, and then developed to make a printing plate, which is then mounted in a printing machine for printing.

Then, the present invention will not be illustrate in and by the following example.

EXAMPLE 1

By the continuous casting apparatus shown in FIG. 1(A), an aluminum plate having a thickness of 2.5 mm was formed and after annealing the plate by the continuous heat-treatment (annealing) apparatus shown in FIG. 1(B) at 500° C. for one minutes, the plate was further cold rolled to the thickness of 0.4 mm by the cold rolling apparatus shown in FIG. 1 (C) to form a test material as Sample [A].

COMPARATIVE EXAMPLE 1

By the continuous casting apparatus shown in FIG. 1(A), an aluminum plate having a thickness of 8 mm was formed, the plate was cold rolled to a thickness of 2.5 mm, thereafter, after annealing the plate by the continuous heat-treatment (annealing) apparatus, the plate was further cold rolled to the thickness of 0.4 mm to form a test material as Sample [B].

Each of the aluminum plates thus-obtained was used as a support for a planographic printing plate as follows. That is, each aluminum plate was etched with a 15%-aqueous solution of sodium hydroxide at 50° C. such that the etched amount became 7 $g/m^2$, after washing the etched plate with water, the plate was immersed in an aqueous sulfuric acid solution of 180 g/liter at 50° C. for 20 seconds to desmut the plate, and the plate was washed with water.

Furthermore, the support was electrochemically grained in 12 g/liter of an aqueous nitric acid solution using the alternating (wave form) electric current described in JP-B-55-19191 (the term "JP-B" as used herein means as "examined published Japanese patent application"). In the electrolytic conditions, the anode voltage Va was 14 volts, the cathode voltage Vc was 12 volts, and the quality of electricity at the anode was 350 $coulombs/dm^2$. Thereafter, the support was desmutted in 200 g/liter of an aqueous sulfuric acid solution and an anodized film of 2.38 $g/m^2$ was formed.

The base plate thus prepared was coated with the photosensitive composition shown below such that the coated amount after drying became 2.0 $g/m^2$ to form a photosensitive layer thereon.

| | |
|---|---|
| N-(4-Hydroxyphenyl) methacrylamide/2-hydroxyethyl methacrylate/acrylonitrile/methyl methacrylate/methacrylic acid (15/10/30/38/7 by mole ratio) copolymer (average molecular weight: 60,000) | 5.0 g |
| Hexafluorophosphate of the condensate of 4-diazo-phenylamine and formaldehyde | 0.5 g |
| Phosphorous acid | 0.05 g |
| Victoria Blue BOH (trade name, made by Hodogaya Chemical Co., Ltd.) | 0.1 g |
| 2-Methoxyethanol | 100.0 g |

The thus produced photosensitive planographic printing plate was subject to exposure through a transparent negative film for 50 sec in a vacuum printing frame with light emitted from a 3 kw metal halide lamp distanced by 1 m. Then, the thus exposed photosensitive planographic printing plate was developed with a developer having the following composition, and gummed with a solution of gum arabic to prepare a final planographic printing plate.

Developer:

| | |
|---|---|
| Sodium Sulfite | 5.0 g |
| Benzyl Alcohol | 30.0 g |
| Sodium Carbonate | 5.0 g |
| Sodium Isopropylnaphthalenesulfonate | 12.0 g |
| Pure Water | 1000.0 g |

As the results of printing by ordinary manner using each of the planographic printing plates thus prepared, it was found that the planographic printing plate using Sample [A] was not easily stained, while the planographic printing plate using Sample [B] was easily stained. Also, as the results of observing the samples after development, it was found that in Sample [B], the rolling unevenness having a width of about 2 mm was sightly generated and when the portion was observed by a scanning electron microscope (SEM), there existed a few portion where the graininess was not uniform.

Also, Sample [A] could be prepared at a low cost as compared with Sample [B] since the cold rolling step was only once.

Effect of the Invention

As described above, by the method of producing a support for a planographic printing plate of the present invention, the production step can be simplified and a support for a planographic printing plate having a good appearance after electrolytic graining and having more excellent graining can be prepared.

Having described out invention as related to the embodiment shown in the accompanying drawing, it is our intention that the invention be not limited by any of the details of description, unless otherwise specified, but rather be construed broadly within its spirit and scope as set out in the accompanying claims.

What is claimed is:

1. A method for producing a support for a planographic printing plate, which comprises after continuous casting an aluminum plate having a thickness of not more than 3 mm from molten aluminum by a twin roller continuous casting method, heat-treating the aluminum plate at a temperature of at least 300° C. with a temperature raising speed of at least 1° C./second, and then reducing the thickness of the plate to 0.5 mm or less by cold rolling.

2. The method of producing a support for a planographic printing plate as claimed in claim 1, wherein the continuous casting method is carried out by twin belt continuous casting and hot rolling molten aluminum.

* * * * *